US008627830B1

(12) United States Patent
Becker

(10) Patent No.: US 8,627,830 B1
(45) Date of Patent: Jan. 14, 2014

(54) HAIRCUT AID AND METHOD OF USE

(71) Applicant: Irvin Becker, Baltimore, MD (US)

(72) Inventor: Irvin Becker, Baltimore, MD (US)

(73) Assignee: Ledge Comb, LLC, Baltimore, MD (US)

( * ) Notice: Subject to any disclaimer, the term of this patent is extended or adjusted under 35 U.S.C. 154(b) by 0 days.

(21) Appl. No.: 13/666,156

(22) Filed: Nov. 1, 2012

(51) Int. Cl.
*A45D 24/00* (2006.01)
*A45D 24/34* (2006.01)
*A45D 24/36* (2006.01)
*A45D 24/10* (2006.01)

(52) U.S. Cl.
USPC ..... 132/200; 132/213; 132/213.1; 132/214; 132/219; 132/148; 132/150

(58) Field of Classification Search
USPC ..... 132/213.1, 213, 214, 219, 200, 212, 132/215, 106, 107, 120, 121, 144, 273, 126, 132/312, 286, 148, 150, 319; 119/600, 610, 119/611, 612–616; 30/26–31, 34.05, 233, 30/233.5, 282, 286, 289; D28/21, 25, 44, D28/44.2
See application file for complete search history.

(56) References Cited

U.S. PATENT DOCUMENTS

| | | | | | |
|---|---|---|---|---|---|
| 737,775 | A * | 9/1903 | Robedeau | 30/30 |
| 937,475 | A * | 10/1909 | Sheffield | 132/148 |
| 938,040 | A * | 10/1909 | Caldwell | 132/148 |
| 1,042,940 | A * | 10/1912 | McConnell | 132/215 |
| 1,623,292 | A * | 4/1927 | Widdows | 132/148 |
| 2,029,792 | A * | 2/1936 | Pluchino | 132/150 |
| 2,155,299 | A * | 4/1939 | Broyles | 132/118 |
| 2,678,048 | A * | 5/1954 | Poetto | 132/156 |
| 2,721,385 | A * | 10/1955 | Ames | 30/233.5 |
| 2,830,600 | A * | 4/1958 | Churchillo | 132/213.1 |
| 3,277,902 | A * | 10/1966 | Korst | 132/150 |
| 3,536,080 | A * | 10/1970 | Legan et al. | 132/213.1 |
| 3,638,665 | A * | 2/1972 | Staffas, Sr. | 132/129 |
| 3,969,819 | A | 7/1976 | Pepera | |
| 4,021,197 | A * | 5/1977 | Brooks | 132/312 |
| 4,532,707 | A | 8/1985 | Allen | |
| 4,830,031 | A * | 5/1989 | Quinones et al. | 132/214 |
| 5,131,418 | A * | 7/1992 | Vaccaro | 132/213.1 |
| 5,231,762 | A | 8/1993 | Hunts | |
| 5,349,971 | A * | 9/1994 | Player | 132/213.1 |
| 5,456,273 | A | 10/1995 | Tungpagasit | |
| 5,865,191 | A * | 2/1999 | Kimeta | 132/210 |
| 5,937,526 | A | 8/1999 | Wahl et al. | |
| 5,937,868 | A * | 8/1999 | Ogunro | 132/213.1 |
| 7,051,442 | B2 * | 5/2006 | McCambridge et al. | 30/233 |
| 7,536,789 | B2 | 5/2009 | Michel | |
| 7,617,936 | B2 * | 11/2009 | Barnett, Jr. | 206/576 |
| 7,909,162 | B1 * | 3/2011 | Barrett | 206/351 |
| 7,926,185 | B2 | 4/2011 | Sugawara | |
| 8,132,540 | B1 | 3/2012 | Strebeigh | |
| 8,176,637 | B2 | 5/2012 | Fukutani et al. | |
| 2008/0072437 | A1 * | 3/2008 | Michel | 30/201 |
| 2013/0025613 | A1 * | 1/2013 | Branch | 132/200 |

* cited by examiner

*Primary Examiner* — Vanitha Elgart
(74) *Attorney, Agent, or Firm* — Whiteford, Taylor & Preston LLP; Joseph L. Morales

(57) ABSTRACT

A haircut aid is described. The haircut aid has a base section that protrudes away from a tine section providing a guide for the blade of a set of clippers, facilitates an even haircut, and protects the ears of the haircut subject from cuts. A method for cutting hair is also described where a set of clippers is run along the guide from by the base section and tine section of a haircut aid.

6 Claims, 3 Drawing Sheets

HAIRCUT AID AND METHOD OF USE

BACKGROUND OF THE INVENTION

1. Field of the Invention

This invention relates to specialized instruments to aid barbers in providing even haircuts to individuals. More particularly, this invention relates to a haircut aid that assists a barber, cosmetologist, hair stylist, or any other person desiring to use a set of electric hair clippers in utilizing such electric clippers and a method for providing a haircut utilizing the haircut aid.

2. Description of the Background

A barber, cosmetologist, hair stylist, or any other person that uses an electric hair clipper may utilize many different implements to assist in executing the task of providing an even haircut. Some of those implements include traditional scissors and combs. The barber can utilize the comb to pull the hair away from the person's scalp before cutting it with the scissors. In other instances, the barber may utilize electric clippers and combs. In such instances, the comb is used to pull the hair away from the individual's scalp and the barber uses the clippers to cut the hair that protrudes from the side of the comb facing away from the individual's scalp. A barber needs to maintain control of the clippers and be very careful to avoid cutting or nicking the ears of the individual receiving the haircut. Barbers learn to use the clippers through experience, but traditional combs fail to assist the barber in protecting the person's ears and easily achieve an even haircut. In other instances, adapters are attached to the clippers to provide cuts of predetermined lengths. The attachments, however, limit the barber's ability to provide cuts of lengths that are different from the standard, predetermined, attachment length.

SUMMARY OF THE INVENTION

It is one object of the present invention to provide a haircut aid comprising a base section and a tine section, where the base section extends outward and away from the tine section. Preferably, the base section extends semi-orthogonally away from the tine section, with the angle between the tine section and the top face of the base section being greater than 90° and as shown generally in the figures. The top face of the base section and the tine section form a guide along which the side edge of a set of clippers may run when used by a barber in cutting an individual's hair, with this configuration, the haircut aid may be used as both a clipper guide and a traditional comb, and may be so used at any location on a person's head. The base section extends outward from the tine section a sufficient distance so as to provide support for the top edge of a pair of hair clippers through the entire swipe of the clippers by the barber across the comb, thus allowing the barber to maintain improved control of the clippers along the entire length of the comb. The base section is positioned and dimensioned so as to protect the person's ears from cuts during the clipping operation. Moreover, the tine section is dimensioned so that the haircut aid provides a wide comb surface that is at least as large as the width of the cutting head of a standard set of clippers, such that the haircut aid provides a guide for the entire width of the clipper blade. The preferable pitch of the base section is configured to allow the barber to slightly pivot the clippers with respect to the tine section when desired. Further, the configuration of the combined base section and wide tine section allows the barber to easily pass the clippers in two directions (i.e., back and forth) along the tine section, and can likewise easily allow left handed clipping, when such clipping operations are desired.

Still further, the above configuration aids in preventing clippers from inadvertently falling below the line of the comb, which can tend to cause inadvertent and unwanted lines of demarcation to appear in the person's hair as the user continues clipping upward along a person's head. Thus, the haircut aid provides clean, even cuts without producing such unwanted lines of demarcation in the person's hair. Moreover, the haircut aid is configured for use with a wide variety of hair styles. More particularly, it may aid in cutting long hair, particularly in perimeter cuts while protecting against damage to a person's clothing, and can be turned over for use in providing a flattop cut given the wide profile of the comb tines of the haircut aid.

It is another object of the present invention to provide a kit having at least one haircut aid. The kit may further contain additional haircut aids of different dimensions. The kit may also comprise a set of clippers, which are used with the appropriate haircut aid to facilitate cutting an individual's hair.

A further object of the present invention is a method for cutting hair utilizing a haircut aid in which a set of clippers is run along the guide formed at the plane where the top face of the base section and the tine section intersect.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION

The invention summarized above may be better understood by referring to the following description, claims, and drawings. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
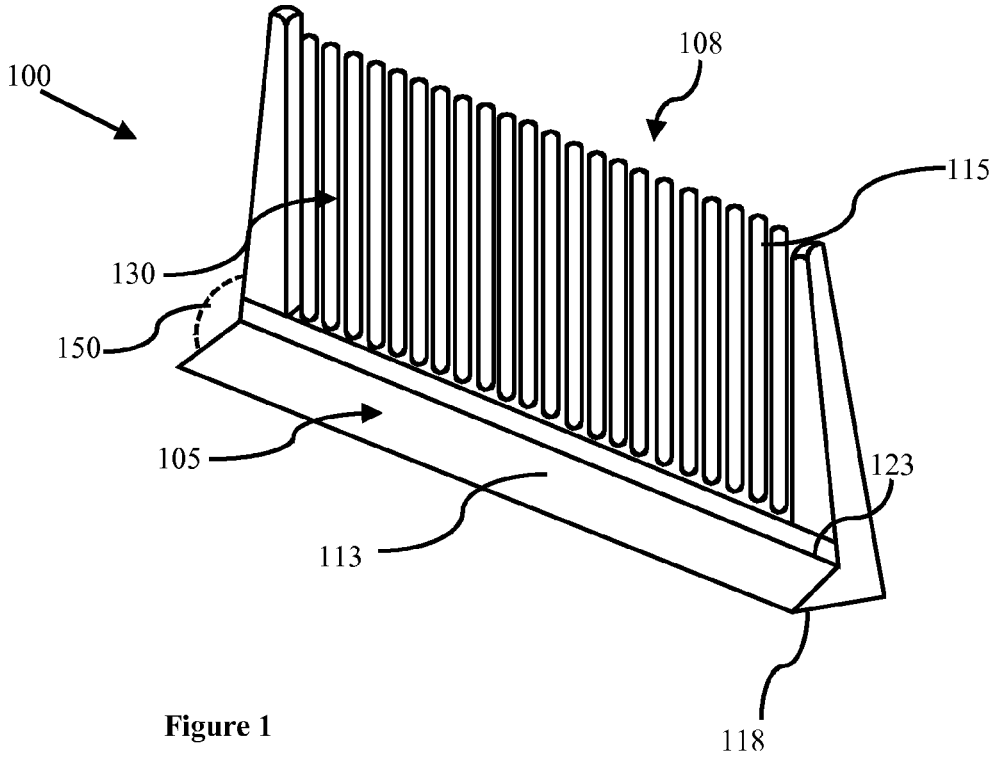
FIG. 1 is a perspective view of one embodiment of a haircut aid.

A haircut aid 100 is shown in FIG. 1. The haircut aid 100 has two sections: a base section 105 and a tine section 108. The base section 105 extends outwards and away from the tine section 108, preferably in a semi-orthogonal fashion. The base section 105 comprises a top face 113 and a bottom face 118. The angle 150 between the front face 130 of the tine section 108 and the top face 113 of the base section 105 is selected so that the base of the haircut aid 100 provides a guide 123 along which a set of hair clippers runs when cutting hair. In one preferred embodiment the angle 150 is preferably greater than 90°, as shown generally in FIG. 1. As used in this application, semi-orthogonal means that the angle 150 between the front face 130 of the tine section 108 and the top face 113 of the base section 105 is not a 90° angle. Thus, the angle 150 between front face 130 of the tine section 108 and the top face 113 of the base section 105 is, in a particularly preferred embodiment, greater than 90° but less than 180°. In some embodiments, the angle is close to 90°. Such angle 150 is selected so as to allow a barber to slightly pivot the clippers with respect to the tine section 108 when desired.

The top face 113 of the base section 105 is designed to serve as the guide 123 for a set of clippers when used by a barber to cut an individual's hair. The top face 113 is a continuous piece of material that allows the set of clippers to glide smoothly along the base section 105 and against the tine section 108. The top face 113 of the base section 105 allows the barber to maintain control of the clippers along the entire length of the base. In addition, the base section 105 protects the individual's ears from cuts and nicks from the clippers because the bottom face 118 of the base 105 sits on top of the ear and serves as a shield for the individual's ears. While FIG. 1 shows that the tines may form an angle of less than 90° with respect to the bottom face 118 of the base section 105, this is optional, and the bottom surface 118 of the base section 105 may extend away from the bottom of tine section 108 at an angle of 90° or more than 90° with respect to the tine section 108 without departing from the spirit and scope of the present invention.

The tine section 108 comprises a plurality of tines 115, which tines are used to comb the individual's hair and pull it away from his or her scalp. The tines 115 are, preferably, at least the same length of the width of a standard set of clipper blades, and thus provide a wide comb surface that supports and guides the clippers for the entire width of the clipper blade surface. It is contemplated that the plurality of tines 115 are arranged, in some embodiments, as a single row of tines. In other embodiments, the plurality of tines 115 are arranged in a plurality or rows or in any other configuration as deemed appropriate to a person of ordinary skill in the art. In yet further embodiments, the plurality of tines 115 are longer or shorter than the width of the clipper's blade.

The foregoing configuration of haircut aid 100 allows the barber to easily pass the clippers across the tine section 108 in two directions (i.e., back and forth) and can likewise easily allow for left handed clipping, when such clipping operations are desired.

In one embodiment, a kit is provided that includes at least one haircut aid 100. In a further embodiment, the kit comprises at least two haircut aids 100 where the haircut aids 100 each have different dimensions. For example, one hair cut aid 100 may be longer than a second haircut aid 100. In other examples, each hair cut aid 100 in the kit may have tines of different lengths and arrangements. In yet a further embodiment, the kit comprises at least one haircut aid 100 and a set of clippers, wherein the haircut aid 100 is sized so that the length of the tines are the same as the length of the blade of the clippers. The kit further comprises a case 301 for each the haircut aid 100. In further embodiments, the case 301 accommodates multiple haircut aids 100 and other haircut implements.

Figure 2:
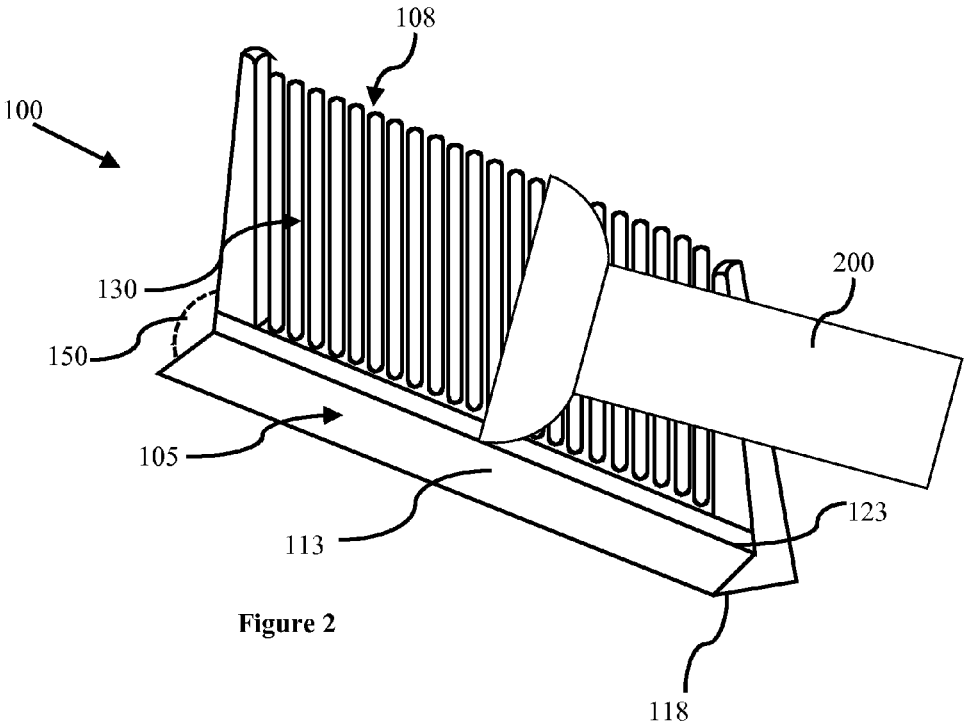
FIG. 2 is a perspective view of one embodiment of a haircut aid with a set of hair clippers being run along the base section of the haircut aid.
Figure 3:
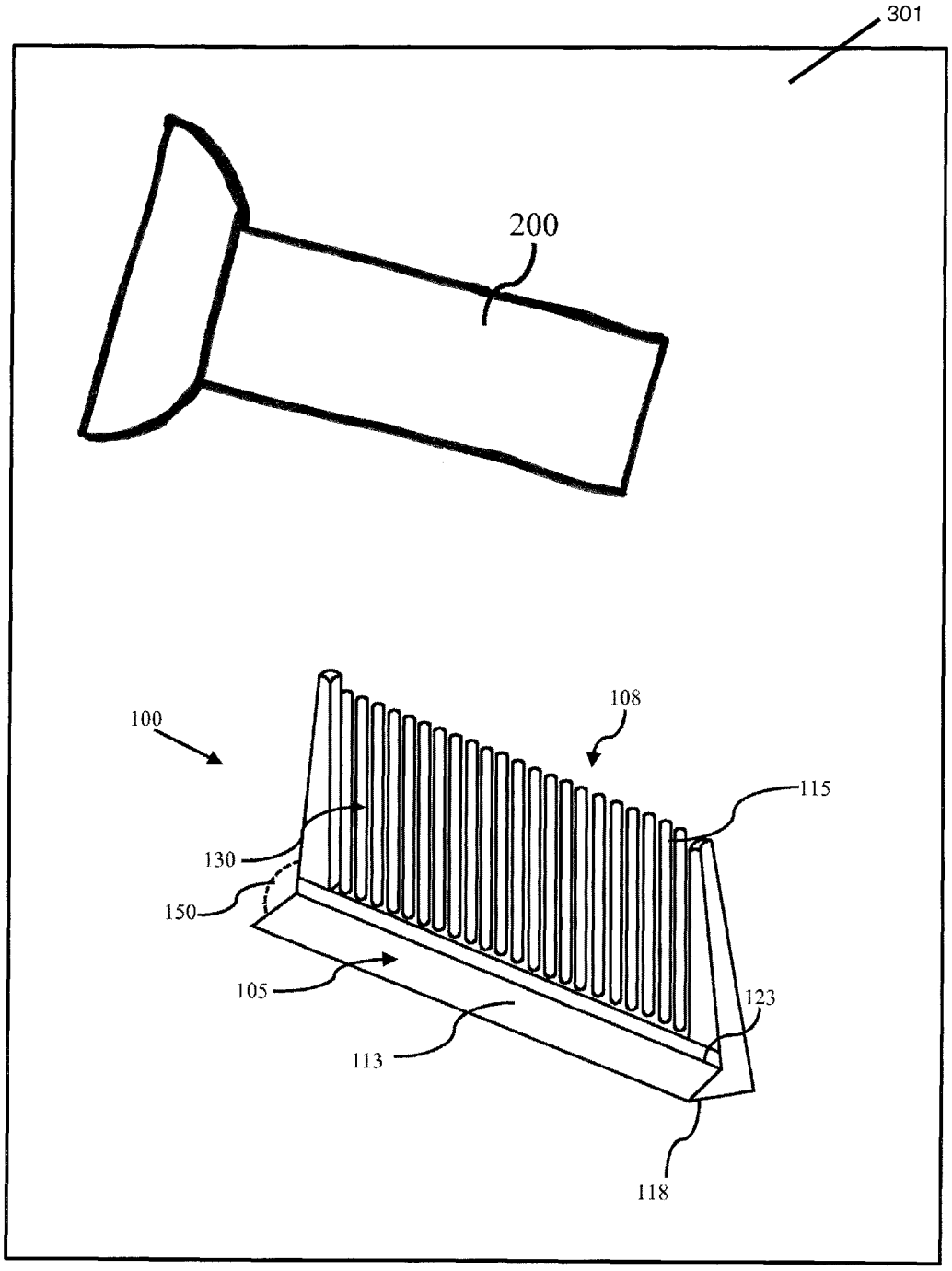
FIG. 3 is a graphical representation of a kit in accordance with one embodiment of the present invention.

The haircut aid 100 is used in a method for cutting hair as shown in FIG. 2. In the first step of the method, the haircut aid 100 is used to pull hair away from a subject's scalp. In a second step, a hair clipper 200 is run along the base section 105 of the haircut aid 100 and against the plurality of tines 115 cutting the hair that protrudes through the spaces between the plurality of tines 115, resulting in an even cut. In an alternative method, the bottom face 118 of the base 105 is placed above the subject's ear during the second step to protect the subject's earlobe. It is contemplated that the haircut aid can be held either on the left or right hand of the barber during the first and second steps of the method of cutting hair.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A haircut aid, comprising:

a base section and a tine section, wherein the base section extends away from the tine section and forms a continuous guide along a length of the base section;

the base section comprises a top face and a bottom face, where a first end of the top face meets a first end of the bottom face forming a straight edge away from the tine section;

a second end of the top face meets a guide section of the tine section, the guide section is configured to allow a set of clippers to slide continuously on a straight line along the guide;

wherein the tine section comprises the guide section and a plurality of tines, the plurality of tines attach to the guide section at a tine attachment section above the line where the guide section and the top face of the base section meet, wherein the spaces between the tines do not extend into the base section;

the top face of the base section forms an angle that is greater than 90° degrees with respect to a front plane of the tine section; and wherein the base section extends continuously from a left end to a right end of the haircut aid.

2. A kit, comprising at least one haircut aid, wherein said haircut aid comprises:

a base section and a tine section, wherein the base section extends away from the tine section and forms a continuous guide along a length of the base section;

the base section comprises a top face and a bottom face, where a first end of the top face meets a first end of the bottom face forming a straight edge away from the tine section;

a second end of the top face meets a guide section of the tine section, the guide section is configured to allow a set of clippers to slide continuously on a straight line along the guide;

wherein the tine section comprises the guide section and a plurality of tines, the plurality of tines attach to the guide section at a tine attachment section above the line where the guide section and the top face of the base section meet, wherein the spaces between the tines do not extend into the base station;

the top face of the base section forms an angle that is greater than 90° degrees with respect to a front plane of the tine section; and wherein the base section extends continuously from a left end to a right end of the haircut aid.

3. The kit of claim 2, further comprising a set of clippers.

4. The kit of claim 2, further comprising a case for the haircut aid.

5. A method for cutting hair, comprising:

pulling hair away from a subject's scalp utilizing a haircut aid, wherein the haircut aid comprises a base section and a tine section, wherein the base section extends away from the tine section and forms a continuous guide along a length of the base section;

the base section comprises a top face and a bottom face, where a first end of the top face meets a first end of the bottom face forming a straight edge away from the tine section;

a second end of the top face meets a guide section of the tine section, the guide section is configured to allow a set of clippers to slide continuously on a straight line along the guide;

wherein the tine section comprises the guide section and a plurality of tines, the plurality of tines attach to the guide section at a tine attachment section above the line where the guide section and the top face of the base section meet, wherein the spaces between the tines do not extend into the base section;

the top face of the base section forms an angle that is greater than 90° degrees with respect to a front plane of the tine section; and wherein the base section extends continuously from a left end to a right end of the haircut aid; and cutting hair that protrudes through spaces between the plurality of tines by running a blade of a set of clippers along the guide.

6. The method of claim 5, further comprising the step of placing said bottom face of the base section over the subject's ear.

* * * * *